US006003165A

United States Patent [19]

Loyd

[11] Patent Number: 6,003,165

[45] Date of Patent: Dec. 21, 1999

[54] PORTABLE SPA WITH SAFETY SUCTION SHUT-OFF

[76] Inventor: Casey Loyd, 4722 W. Mission Blvd., Ontario, Calif. 91762

[21] Appl. No.: 08/967,675

[22] Filed: Nov. 10, 1997

[51] Int. Cl.[6] ..... A47K 3/00

[52] U.S. Cl. ..... 4/541.1; 4/507

[58] Field of Search ..... 4/541.2, 507, 509, 4/538, 508, 541.3, 541.1, 541.4, 541.5

[56] References Cited

U.S. PATENT DOCUMENTS

| | | | |
|---|---|---|---|
| 4,797,958 | 1/1989 | Guzzini | 4/541.2 |
| 5,167,041 | 12/1992 | Burkitt, III | 4/541.2 |
| 5,570,481 | 11/1996 | Mathis et al. | 4/541.2 |
| 5,725,359 | 3/1998 | Dongo et al. | 4/509 |

*Primary Examiner*—David J. Walczak
*Attorney, Agent, or Firm*—Sheldon & Mak; Denton L. Anderson

[57] ABSTRACT

A portable spa has a recirculation system with an automatic vacuum breaking mechanism for preventing objects, such as small children, from becoming lodged at the discharge opening at the bottom of the spa. The recirculation system includes a vacuum sensor adapted to sense the amount or rapid change in the amount of vacuum within the discharge conduit of the recirculation system. When a pre-defined vacuum parameter exceeds a pre-determined set point, the safety switch automatically engages the vacuum breaking means, such as recirculation pump power relays, so as to immediately break the vacuum at the discharge pump.

10 Claims, 2 Drawing Sheets

PORTABLE SPA WITH SAFETY SUCTION SHUT-OFF

FIELD OF THE INVENTION

This invention relates generally to portable spas and, more particularly, to portable spas having recirculating water systems.

BACKGROUND OF THE INVENTION

Portable spas have become enormously popular throughout the world. Portable spas generally comprise a molded tub vessel sufficiently large to seat one or more people. Disposed within the walls of the tub vessel are openings to allow for the ingress and egress of water.

Generally the water egress opening in the tub vessel is connected by a pump to one or more water ingress openings in the tub vessel to allow the recirculation of water within the tub vessel.

Such water recirculation systems have been found to entail a problem. That is, under certain circumstances, the egress opening at the bottom of the tub vessel can have sufficient suction force to adhere an object to the egress opening. In at least one instance, a small child was drown in this way.

Accordingly, there is a need for a portable spa recirculation system which efficiently and inexpensively eliminates this problem.

SUMMARY OF THE INVENTION

The invention satisfies this need. The invention is a recirculation system useable in a portable spa wherein the spa has a tub vessel for retaining warm water. The recirculation system comprises: (a) a water pump having a discharge side and a suction side; (b) a discharge conduit connecting the discharge side of the pump with the tub vessel; (c) a suction conduit connecting the suction side of the pump with the tub vessel; (d) a vacuum sensor adapted to detect the vacuum within the suction conduit; and (e) vacuum breaking means for breaking a vacuum in the suction conduit whenever a vacuum parameter within the suction conduit traverses a predetermined set point.

In a typical embodiment of the invention, the vacuum parameter is the degree of vacuum itself.

In a preferred embodiment of the invention, the recirculation system further comprises a microprocessor and the vacuum parameter is the increase in the degree of vacuum per unit of time.

In a typical recirculation system, the vacuum breaking means includes means for shutting down the power to all elements of the recirculation system.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figures 1, 1A, 1B:
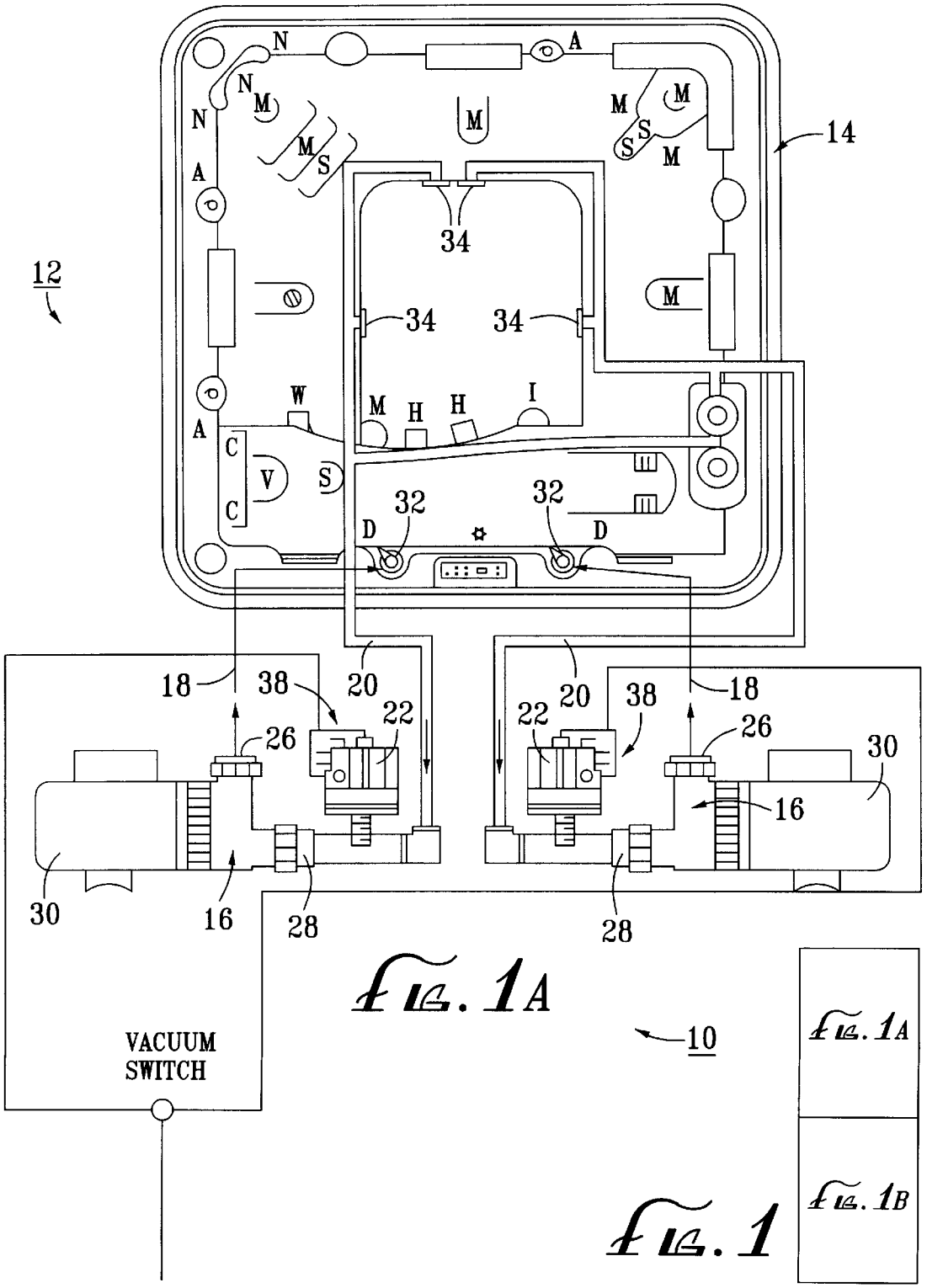
FIG. 1 is a diagrammatic view of a portable spa having a recirculation system with features of the invention.
Figure 1B:
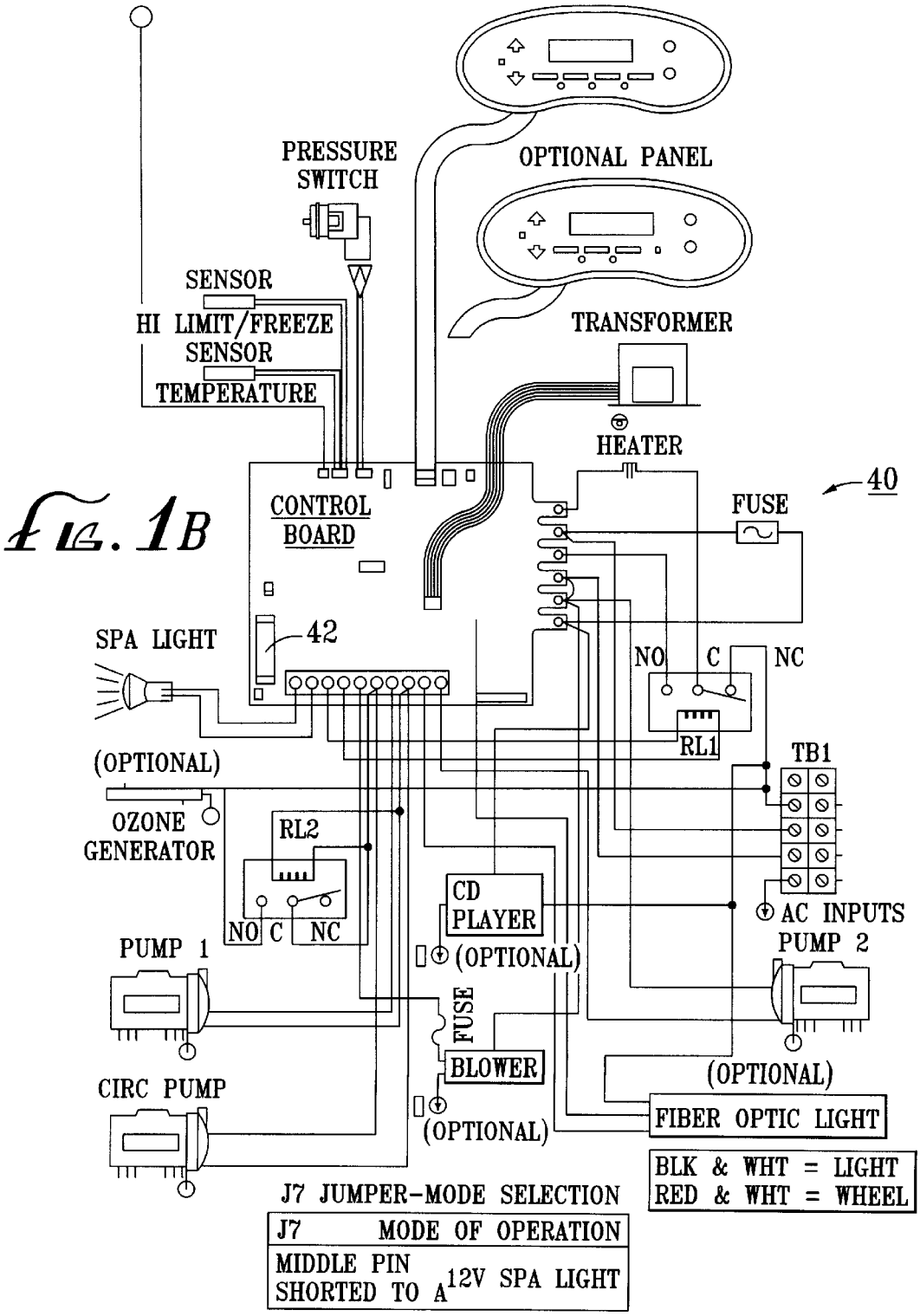

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a recirculation system 10 useful in a portable spa 12 having a tub vessel 14 for retaining warm water. The term "portable spa" as used herein is meant to be interpreted broadly to include all pre-fabricated tub-containing structures having a water recirculation system, including products commonly termed "spas," "hot tubs" and "recirculating bathtubs".

The recirculation system 10 of the invention comprises a water pump 16, a discharge conduit 18, a suction conduit 20, a vacuum sensor 22 and vacuum breaking means.

The water pump 16 has a discharge side 26 and a suction side 28.

The water pump 16 is generally driven by an electrical motor 30. In the embodiment shown in FIG. 1, the system comprises a pair of water pumps 16, disposed in parallel. A typical water pump 16 delivers about 10–200 gpm at a discharge pressure of about 1–20 psig.

The discharge conduit 18 connects the discharge side 26 of the pump and the tub vessel 14. In a typical portable spa 10, the discharge conduit 18 allows the ingress of water into the tub vessel 14 via a diverter valve 32 which routes ingressing water to a plurality of inlet jets H, including high velocity jets M, medium velocity jets and slow velocity jets S.

The suction conduit 20 connects the suction side 28 of the pump 16 with the tub vessel 14. The suction conduit 20 draws water from near the bottom of the tub vessel 14 via one or more drain openings 34.

In operation, the tub vessel 14 is filled with warm water and such water is constantly recirculated via the tub vessel drain opening 34, the suction conduit 20, the water pump 16, the discharge conduit 18, the diverter valves 32 and the ejection jets H, M and S.

The vacuum sensor 22 is disposed along the suction conduit 20 and is adapted to detect vacuum within the suction conduit 20. For example, the vacuum parameter could be set to activate the vacuum breaking means when the vacuum within the suction conduit 20 reaches a pre-set value between about 50" and about 1000" of water, such as about 250" of water, in a time period of about 1–5 seconds. However, the vacuum parameter could be set as low as about 25" of water, if desired.

The vacuum breaking means can be any system for releasing the vacuum within the suction conduit 20. In a typical embodiment, the vacuum breaking means comprises a electrical relay (not shown) or similar equipment for shutting down at least the water pump 16. Preferably, the vacuum breaking means is adapted to shut down all of the operating equipment within the recirculation system 10.

The safety switch 38 can be a diaphragm switch, such as Model No. VM124OE-300WI, sold by Press-Air-Trol of Mamaroneck, N.Y.

FIG. 1 illustrates a typical installation including a vacuum switch 38 operatively connected to the suction conduit 20 and an electronic circuit board 40 that controls all of the operating equipment associated with the portable spa 12. The electronic circuit board 40 includes a microprocessor 42 that receives a signal from the safety switch 38. Typically, the signal is on the order of 5 volts (direct current) and 0.25 milliamps.

Normally, a modest suction of less than 25" of water within the suction conduit is detected by the vacuum sensor 22. If and when an object becomes retained by the suction at that drain opening 34, the resulting increased vacuum within the suction conduit 20 is detected by the vacuum sensor 22. The sudden increase in vacuum quickly exceeds the predetermined set point of the vacuum parameter which causes the safety switch 38 to automatically activate the vacuum breaking means—such as by the cutting off of power to the water pump 16—whereupon the vacuum is broken and the object is released from the tub vessel drain opening 34.

After the blockage is removed and the vacuum pressure within the suction conduit 20 is returned to normal, the safety switch 38 is preferably reset manually and the portable spa 12 is again operatable by the user.

The invention provides a very important safety feature which prevents any possibility of a young child from being drowned because of the suction forces inherent in the spa's recirculation system.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A portable spa having a tub basin for retaining warm water comprising:

(a) a water pump having a discharge side and a suction side;

(b) a discharge conduit connecting the discharge side of the pump with the tub basin;

(c) a suction conduit connecting the suction side of the pump with the tub basin;

(d) a vacuum sensor attached to the suction conduit and adapted to detect a vacuum within the suction conduit; and (e) vacuum breaking means for breaking the vacuum in the suction conduit; and (f) a microprocessor for activating the vacuum breaking means whenever a vacuum parameter of the vacuum detected by the vacuum sensor traverses a predetermined set point.

2. The portable spa of claim 1 wherein the vacuum parameter is a decree of vacuum.

3. The portable spa of claim 1 further comprising a microprocessor and wherein the vacuum parameter is the increase in vacuum per unit time.

4. The portable spa of claim 3 wherein the vacuum parameter is a rise in vacuum of between about 50 inches and about 1,000 inches of water in a time period of about 1–5 seconds.

5. The portable spa of claim 1 wherein the vacuum breaking means includes means for shutting down the pump.

6. A spa having a tub basin for retaining warm water, and a recirculation system having a plurality of water pumps for recirculating water to and from the tub basin, each water pump comprising:

(a) a discharge conduit connecting the discharge side of each pump with the tub basin;

(b) a suction conduit connecting the suction side of each pump with the tub basin;

(c) a vacuum sensor attached to the suction conduit and adapted to detect a vacuum within each suction conduit; and (d) vacuum breaking means for breaking the vacuum in each suction conduit; and (f) a microprocessor for activating the vacuum breaking means whenever a vacuum parameter of the vacuum detected by the vacuum sensor traverses a predetermined set point.

7. The portable spa of claim 6 wherein the vacuum parameter is vacuum.

8. The portable spa of claim 6 wherein the vacuum parameter is increase in vacuum per unit time.

9. The portable spa of claim 8 wherein the vacuum parameter is an increase in vacuum of between about 50 inches and about 1,000 inches of water in a time period of about 1–5 seconds.

10. The portable spa of claim 6 wherein the vacuum breaking means includes means for shutting down the pump.

* * * * *